United States Patent [19]

Sapp et al.

[11] Patent Number: 5,011,058

[45] Date of Patent: Apr. 30, 1991

[54] LEAF BLOWER BACK PACK FRAME

[75] Inventors: Michael D. Sapp, Rockwell; Donald R. Gaskey, Jr., Monroe, both of N.C.

[73] Assignee: Textron Inc., Providence, R.I.

[21] Appl. No.: 472,653

[22] Filed: Jan. 30, 1990

[51] Int. Cl.[5] ..... B05B 3/10

[52] U.S. Cl. ..... 224/261; 15/327.5; 224/907; 224/210; 224/270

[58] Field of Search ..... 224/209, 210, 211, 212, 224/215, 259, 260, 261, 262, 264, 270, 907; 15/327 C, 339, 405

[56] References Cited

U.S. PATENT DOCUMENTS

| | | | |
|---|---|---|---|
| 1,981,076 | 11/1934 | Sells . | |
| 2,519,936 | 8/1950 | Sayre . | |
| 2,520,559 | 8/1950 | Osius . | |
| 2,792,670 | 5/1957 | Haynes . | |
| 3,165,774 | 1/1965 | Barba | 15/327 C |
| 3,219,129 | 11/1965 | Yamada . | |
| 3,331,090 | 7/1967 | Reiber et al. | 15/321 |
| 4,290,165 | 9/1981 | Hiramatsu et al. | 15/330 |
| 4,483,070 | 11/1984 | Junkermann | 30/296 |
| 4,572,414 | 2/1986 | Blatt | 224/212 |
| 4,644,654 | 2/1987 | Howe et al. | 30/296 |
| 4,651,903 | 3/1987 | Paglisi | 222/175 |
| 4,658,778 | 4/1987 | Gamoh et al. | 123/195 C |
| 4,662,551 | 5/1987 | Dudley et al. | 224/211 |
| 4,748,712 | 6/1988 | DiGiovanni | 15/327 C |

OTHER PUBLICATIONS

McCulloch Advertisement for "Super Air Stream V Back Pack Gas Blower Makes a Clean Sweep of Yard Work." 2 pages (1987).

McCulloch User Manual for "Super Air Stream V and Eager Beaver Gas-Powered Back-Pack Blower". 16 pages (1987).

*Primary Examiner*—Ernest G. Cusick

*Attorney, Agent, or Firm*—Perman & Green

[57] ABSTRACT

A leaf blower having a back pack frame. The frame can support a leaf blower unit on an operator's back with the use of shoulder straps. The frame generally has an L-shape with an intake restrictor ring that can cooperate with an air intake section of a blower mounted to the back pack frame to substantially prevent intrusion of foreign objects into the blower unit and to reduce noise emanating from the blower air intake section.

12 Claims, 4 Drawing Sheets

LEAF BLOWER BACK PACK FRAME

BACKGROUND OF THE INVENTION

1. Field of the Invention

The present invention relates to a device for carrying a machine and, more particularly, a back pack type frame for carrying a leaf blower.

2. Prior Art

Various different back pack type frames are known in the prior art for carrying various machines. U.S. Pat. No. 4,658,778 to Gamoh et al. disclosed an L-shaped frame for carrying a blower unit that is comprised of synthetic resin and conduits air through a hollow portion of the frame to reduce noise from the blower unit. U.S. Pat. No. 2,519,936 to Sayre discloses a portable power tool with a supporting structure which is hollow for passing air therethrough to thermally insulate the back of an operator.

Several problems have been encountered with back pack frames used in the prior art. Generally, with machines such as leaf blowers that intake a relatively large amount of air, air intakes are located proximate vertical sections of back pack frames for various reasons. However, this can reduce the quantity of air flowing into the intake and does not optimize noise reduction and prevention of intrusion of foreign objects into the intake.

It is therefore an objective of the present invention to provide an improved back pack type frame for use with machines having air intakes that can intake a relatively large amount of air, reduce the level of noise from an air intake and enhance the prevention of intrusion of foreign objects into the intake.

SUMMARY OF THE INVENTION

The foregoing problems are overcome and other advantages are provided by a back pack frame having an inlet restrictor.

In accordance with one embodiment of the present invention, a back pack for use in carrying a blower is provided. The back pack has a frame and straps for removably supporting the back pack and blower on an operator. The frame comprises a first portion and a second portion. The first portion is adapted to, at least partially, removably support a blower thereon. The second portion is fixedly connected to the first portion and has a first side and a second side. The first side is adapted to be removably supported on an operator's back. The second side has an intake restrictor extending therefrom and being suitably sized and shaped and suitably located relative to the first portion for operably cooperating with an air intake of a blower mounted to the back pack to substantially prevent intrusion of foreign objects into a blower air intake and to reduce noise emanating from a blower air intake.

In accordance with another embodiment of the present invention, a blower is provided comprising a blower unit and a back pack frame. The blower unit has an engine, an air intake section, an air outlet, and means for blowing air from the air intake section to the air outlet. The back pack frame has a general L-shape with a first horizontal portion and an integral second vertical portion and is comprised of a thermoplastic material The first portion is adapted to, at least partially, support the blower on a top side thereof. The second portion has a first side and a second side. The second side has an intake restrictor extending therefrom which is suitably sized and shaped to substantially surround the air intake section to substantially prevent intrusion of foreign objects into the air intake section and to reduce noise emanating from the air intake section, but to allow air to access the air intake section.

In accordance with another embodiment of the present invention, a back pack for use in carrying a blower is provided. The back pack has an L-shaped frame and straps for removably supporting the back pack and a blower on an operator. The frame comprises means for mounting a blower to the frame, and means for substantially preventing intrusion of foreign objects into the blower air inlet and for reducing noise emanating from a blower air inlet including an inlet restrictor ring extending from a portion of the L-shaped frame and being suitably sized and shaped to substantially surround an air inlet of a blower mounted to the back pack and for operably cooperating with an air inlet of a blower.

DETAILED DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
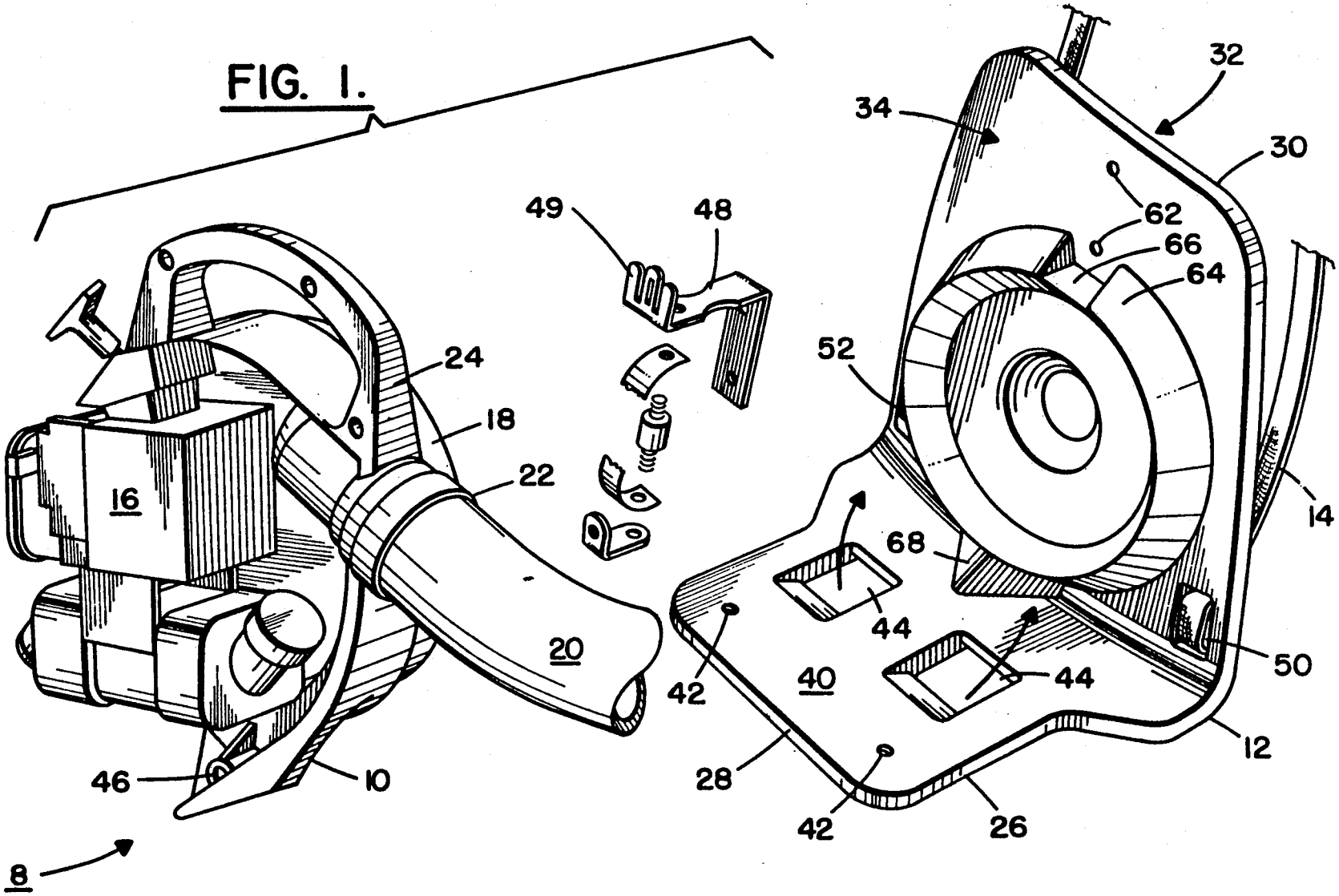
FIG. 1 is an exploded perspective view of a blower unit and a back pack for carrying the blower unit incorporating features of the present invention.
Figure 3:
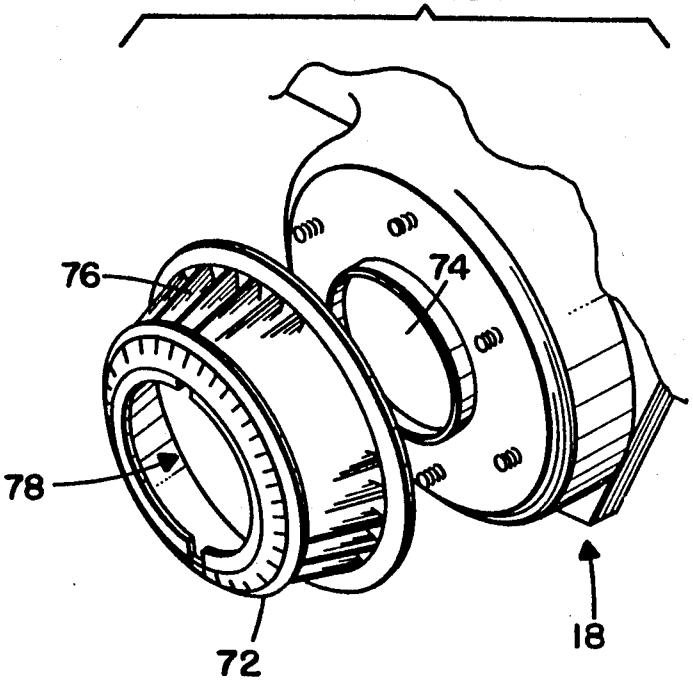
FIG. 3 is a partial exploded view of an intake to a blower unit.
Figure 2:
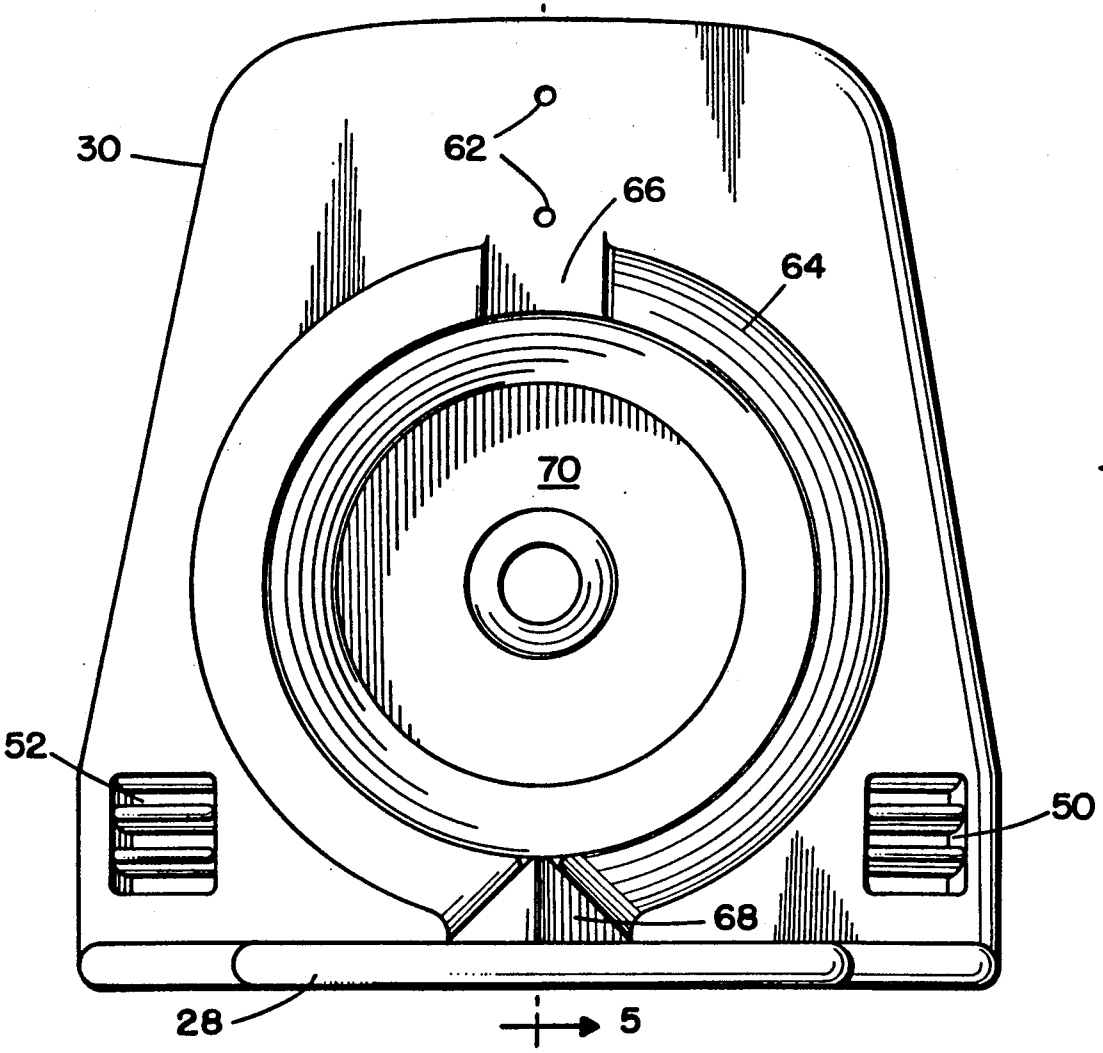
FIG. 2 is a rear plan view of the frame of the back pack shown in FIG. 1.

Referring to FIG. 1, there is shown a partial exploded view of a blower 8 generally comprised of a blower unit 10 and a back pack 12. The blower 8 is generally intended to be carried by an operator with the use of shoulder straps 14 such that the back pack is supported on an operator's back. The blower unit 10, in the embodiment shown, is of a conventional design and generally comprises an engine 16, an air intake section 18, and a conduit 20 having an air outlet (not shown) at its distal end. A proximal end 22 of the conduit 20 is connected to a frame 24 of the blower unit 10. The blower unit 10 also comprises a suitable impeller (not shown) connected to the engine 16 and located within the frame 24 that, when rotated by the engine, the impeller can suck air via the air intake section 18 and discharge the air through the conduit 20 to its air outlet for such purposes as blowing leaves or moving cut grass clippings. It should be understood that although the present invention is being described with reference to the blower unit 10, which is commonly known as a leaf blower, the present invention can be used with any suitable machine intended to be carried by an operator having an air intake that can intake a relatively large amount of air. It should also be understood that the present invention may include any suitable size, shape, or type of materials without departing from the spirit of the invention.

Referring also to FIGS. 2-9, the back pack 12 will be further described. In the embodiment shown, the back pack 12 is generally comprised of a frame 26 and shoulder straps 14. The frame 26, in the embodiment shown, is generally comprised of a single thermoplastic member having a general L-shape. As can best be seen in FIG. 5, the frame 26, in the embodiment shown, is constructed as a dual wall construction with a relatively hollow space between the walls. The L-shape of the frame 26 is generally formed by the frame having a first portion 28 and a substantially perpendicular second portion 30. The second portion 30 is generally intended to be vertically orientated when the back pack 12 is mounted on an operator and the second portion 30 is slightly curved to generally conform to the curved shape of an operator's back and is generally comprises a first side 32 and a second side 34. The first side 32, in the embodiment shown, generally comprises a recessed area 36 for receiving a cushion pad (not shown) for more comfortably supporting the blower 8 adjacent an operator's back. Suitable holes 38 are provided through the first side 32 such that screws (not shown) can fixedly mount the cushion pad (not shown) to the frame 26. However, a cushion pad need not be provided.

The first portion 28 of the frame 26 generally extends away from the second side 34 of the second portion 30 at a substantially right angle and forms a platform having a top side 40 for supporting, at least partially, the blower unit 10 thereon. In the embodiment shown, the first portion 28 generally comprises two mounting holes 42 and two stiffener holes 44. Generally, two connectors (not shown) pass through the mounting holes 42 and through suitable mounting holes 46 in the frame 24 of the blower unit 10 for fixedly mounting the blower unit 10 to the back pack 12. In the embodiment shown, a top support bracket 48 is provided between the back pack frame 26 and the top of the blower frame 24 for further stabilizing the mounting of the blower unit 10 to the back pack frame 26. In a preferred embodiment of the present invention, the connectors (not shown) used between the mounting holes 42 on the back pack frame 26 and the mounting holes 46 on the blower unit frame 24 are provided as quick dismount or quick disconnect connectors which can allow for an operator to relatively quickly and easily dismount the blower unit 10 from the back pack 12. Obviously, the connector (not shown) between the top support bracket 48 and the top of the blower unit frame 24 can also be provided as a quick disconnect connector. In the embodiment shown, the stiffener holes 44, provided in the first portion 28, are generally provided to reduce the weight of the frame 24 and increase the rigidity and stiffness of the frame 24. The stiffener holes 44 can also allow air to be drawn therethrough for induction into air intake section 18 and/or cooling of the engine 16.

Figure 9:
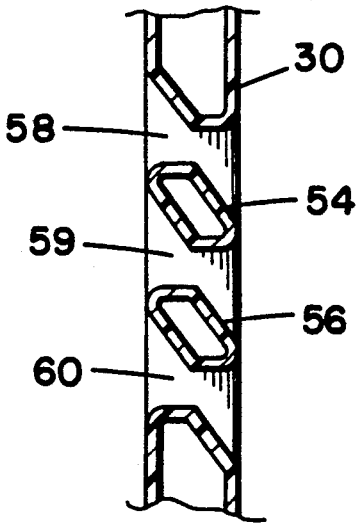
FIG. 9 is a partial cross sectional view of the frame shown in FIG. 4 taken along line 9—9.

As described above, the back pack frame second portion 30 generally comprises a first side 32 and second side 34. In the embodiment shown, located proximate the bottom of the second portion 30 on opposite sides thereof and passing through the second portion between the first side 32 and second side 34 are two strap mounts 50 and 52 for connecting at least one end of the straps 14 therewith. As shown in FIG. 9, the strap mounts 50 and 52 generally comprise two bar sections 54 and 56 and three aperture channels 58, 59, and 60. The portions of the straps 14 can be passed through the aperture channels 58, 59 and 60 to securely mount the ends of the straps 14 to the bar sections 54 and 56. However, any suitable means may be provided for connecting the straps. In the embodiment shown, located at the top of the second side 34 are two holes 62 provided such that connectors (not shown) can be passed therethrough for connecting the top support bracket 48 to the top of the second portion 30. The tops of the straps 14 can be connected to the top bracket 48 at strap mounts 49. In the embodiment shown, the second side 34 of the second portion 30 is provided with an intake or inlet restrictor or shield 64 that projects therefrom.

In the embodiment shown, the restrictor 64 is generally provided to restrict or substantially prevent the intrusion of foreign objects into the air intake section 18 of the blower unit 10. The restrictor also provides the feature of acting as a muffler to dampen the level of noise emanating from the air intake section 18 of the blower unit 10. In addition, the present invention allows for the elimination of an access cover door on the blower unit without a reduction of safety as will be described below. Further, the present invention also can provide all of these features and also enhance air flow into the air intake section 18 of the blower.

In the embodiment shown, the restrictor 64 has a general ring shape. A top portion of the ring has a notch 66 for accommodating a portion of the top support bracket 48. However, in an alternate embodiment, the notch 66 need not be provided. Located at the bottom of the ring is a triangular shape 68 which is generally provided to add structural rigidity between the first and second portions 28 and 30. However, any suitable type of means may be used for structural rigidity at the junction of the first and second portions 28 and 30 and the triangular shape 68 need not be provided. Apart from the top notch 66 and bottom triangular shape 68, in the embodiment shown, the ring has a general triangular cross-section and forms a recess 70 for at least partially receiving a portion of the air intake section 18 of the blower unit 10 as shown in FIG. 5.

Generally, the air intake section 18 is comprised of a grill 72 and an air inlet aperture 74 in the blower frame 24 that leads to a chamber (not shown) containing the impeller (not shown). The grill 72 is ring or disk shaped with members 76 forming a grill profile and a central aperture 78 at the front of the grill. The members 76 that form the grill profile can substantially prevent foreign objects from entering the chamber (not shown) containing the impeller (not shown) through the side of the grill 72. The central aperture 78, however, is relatively open which, if not in some manner covered, would allow for foreign objects to pass therethrough. The relatively open central aperture 78 is a desired feature in a blower unit because it is necessary in order to connect a conduit therethrough when the blower unit is converted into a vacuum device as is known in the art. In the past, an access cover door was provided on the grill 72 to cover the central aperture 78 when the blower unit was in its blower configuration. However, the present invention allows for the elimination of the need for an access cover door through the use of the restrictor ring 64 that can substantially prevent foreign objects from passing through the central aperture 78 when the blower unit 10 is mounted to the back pack 12.

Figure 5:
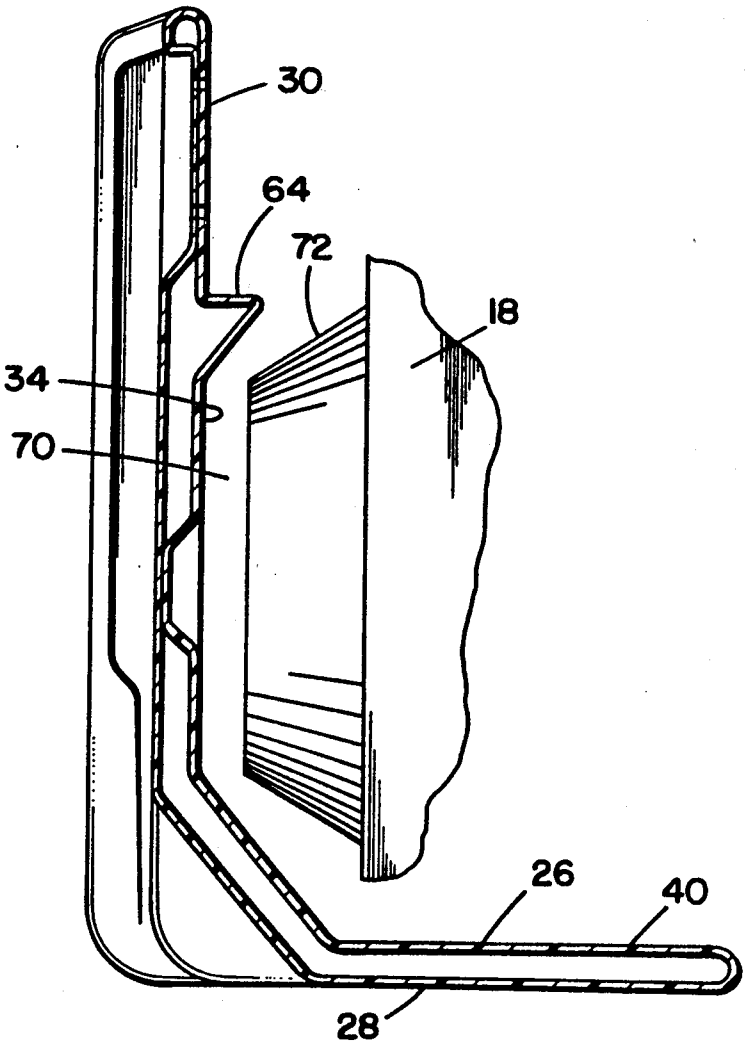
FIG. 5 is a cross-sectional view taken along line 5—5 of FIG. 2 and a partial side view of a blower unit and its position and location relative to the frame when mounted thereto.
Figure 4:
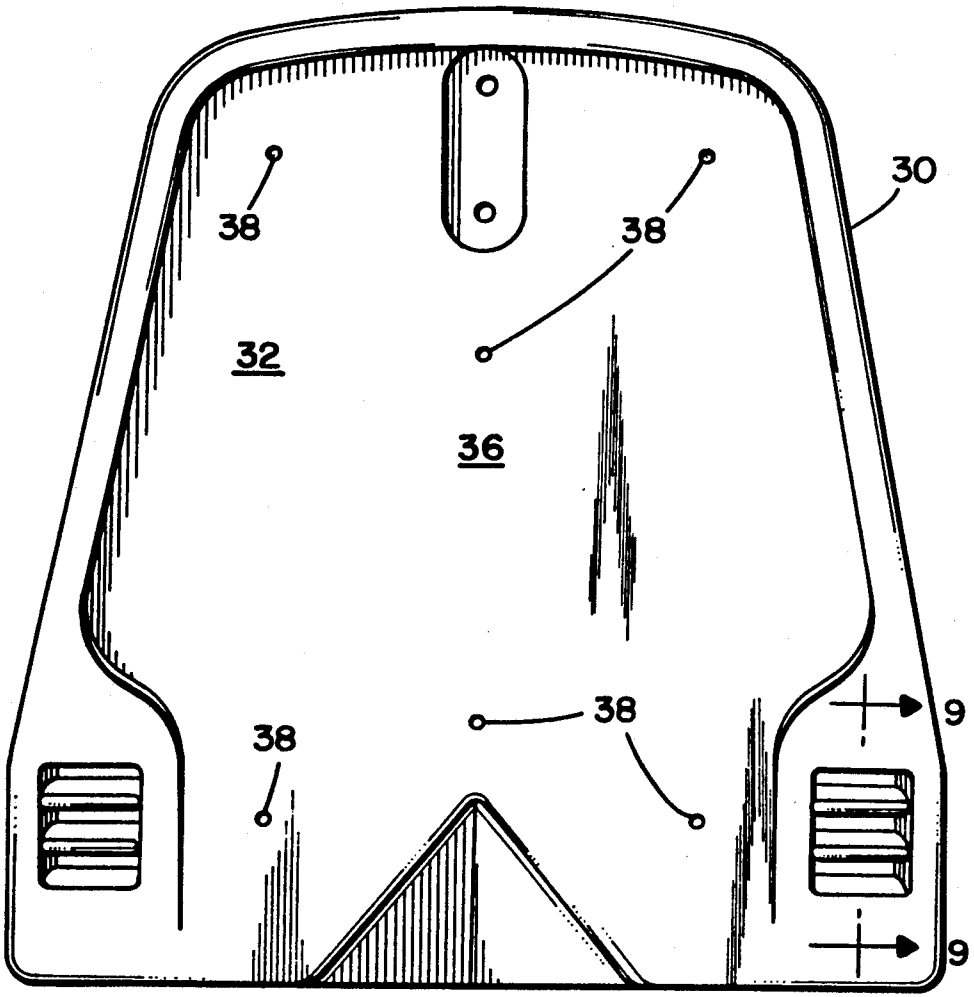
FIG. 4 is a front plan view of the frame shown in FIG. 2.

As best shown in FIG. 5, when the blower unit 10 is mounted to the back pack frame 26, a leading portion of the grill 72 having the central aperture 78 therein extends into the recess 70. The grill is kept at a suitable spacing from the back pack frame 26 to substantially prevent access of foreign objects to the central aperture 78, but nonetheless provide adequate spacing for the free flow of air into the air intake section. Thus, foreign objects are substantially prevented for passing into the air intake section through the central aperture 78 even though no access cover door is provided. The presence of the restrictor ring 64 and second wall 34 inside the restrictor ring 64 in close proximity to the central aperture 78 in the grill 72 also provides suitable safety, preventing an operator from inadvertently putting a finger or fingers in the central aperture 78. Thus, the present invention allows for elimination of the access cover door on the grill 72 without a reduction of safety. Because air can pass into the recess 70 between the grill 72 and restrictor 64 and be sucked into the air intake section 18 through the grill central aperture 78, unlike in the prior art which prevented this because of the presence of an access cover door in the grill central aperture, the present invention allows for enhanced air flow into the air intake section. Of course, the back pack frame 26 can also be used with a blower unit 10 that has an access cover door. In a preferred embodiment, the blower unit 10 can be suitably provided to be intended only for a blower configuration and thus intended to be fixedly mounted to the back pack frame 26 without an access cover door. Because a portion of air intake section 18 is located in the recess 70 of the restrictor ring 64, the recess 70 acts as a muffler to dampen the level of sound emanating from the operation of the blower unit 10 exiting the air intake section 18.

Figure 6:
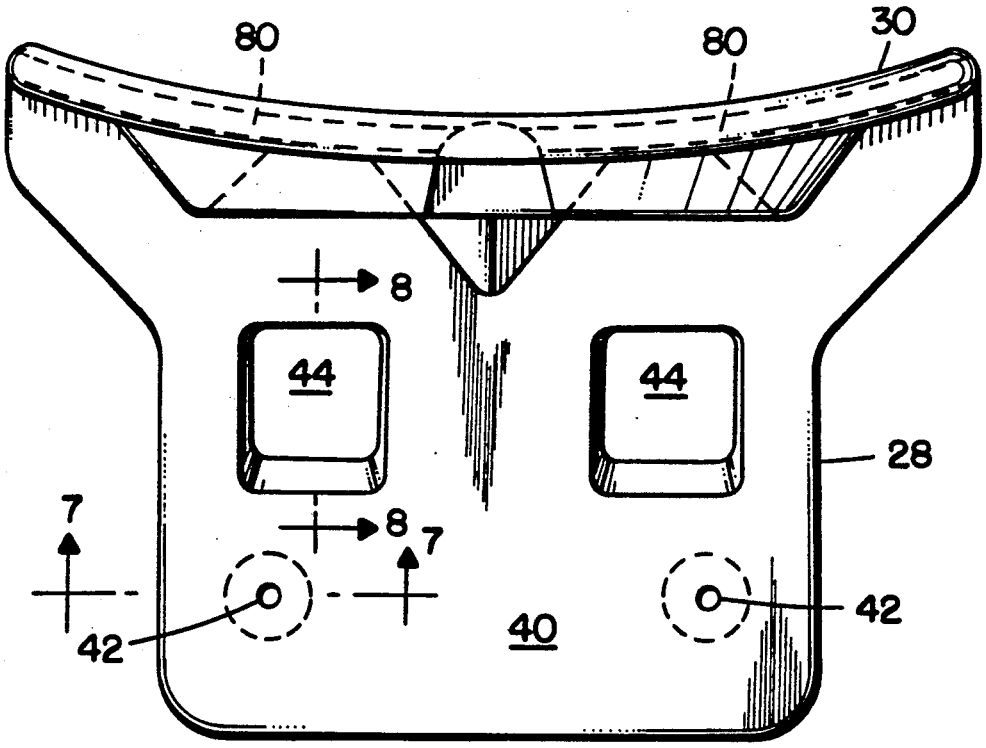
FIG. 6 is a top plan view of a frame as shown in FIG. 2 with cooling holes and channels shown in dashed lines.
Figure 7:
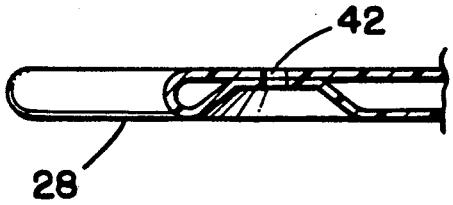
FIG. 7 is a partial cross sectional view of the frame shown in FIG. 6 taken along line 7—7.
Figure 8:
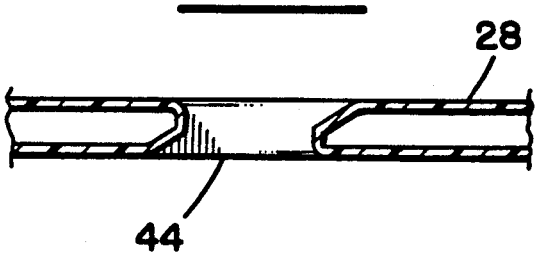
FIG. 8 is a partial cross sectional view of the frame shown in FIG. 6 taken along line 8—8.

In the embodiment shown in FIG. 6, air channels or holes 80 are provided through the second portion 30 such that air can be drawn through the second portion 30 to be supplied to the recess 70 and blower air intake. The flow of air in channels 80 can generally insulate or cool an operator's back from the heat of the engine 16. However, any suitable type of insulation or cooling could be provided. Alternatively, no cooling or insulation need be provided.

It should be understood that the foregoing description is only illustrative of the invention. Various alternatives and modifications can be devised by those skilled in the art without departing from the scope of the invention. Accordingly, the present invention is intended to embrace all such alternatives, modifications and variances which fall within the scope of the appended claims.

What is claimed is:

1. A back pack for use in carrying a blower, the back pack having a frame and straps for removably supporting the back pack and blower on an operator, said frame comprising:

a first portion adapted to, at least partially, removably support a blower thereon; and a second portion fixedly connected to said first portion and having a first side and a second side, said first side being adapted to be removably supported on an operator's back, said second side having an intake restrictor suitably sized, shaped, and located relative to said first portion for operably cooperating with an air intake of a blower mounted to the back pack to provide a restrictive air flow space between the blower and said second side and, said restrictor is adapted to substantially prevent intrusion of foreign objects into a blower air intake, to reduce noise emanating from a blower air intake, and to nonetheless allow proper air flow through the space into the blower air intake.

2. A back pack as in claim 1 wherein said first and second portions are integrally formed from a thermoplastic material.

3. A back pack as in claim 2 wherein said frame is substantially a double walled hollow structure.

4. A back pack as in claim 1 wherein said first portion comprises holes therethrough for passage of air.

5. A back pack as in claim 1 wherein said second portion first side is relatively curved to comfortably conform to the shape of an operator's back.

6. A back pack as in claim 1 wherein said second portion has holes passing therethrough for passage of air such that air can be supplied to a blower air intake and can be drawn across an operator's back for cooling of the operator.

7. A blower comprising:

a blower unit having an engine, an air intake, an air outlet, and means for blowing air from said air intake to said air outlet; and a back pack frame having a general L-shape with a first horizontal portion and an integral second vertical portion and being comprised of a thermoplastic material, said first portion being adapted to, at least partially, support said blower on a top side thereof, said second portion having a first side and a second side, said second side having an intake restrictor extending therefrom, said intake restrictor being suitably sized, shaped, and located relative to said air intake to be spaced from said air intake and substantially surround a portion of said air intake to allow air to access said air intake through a space between said air intake and said second side, but adapted to substantially prevent intrusion of foreign objects into said air intake through said space and to reduce noise emanating from said air intake.

8. A blower as in claim 7 wherein said frame is substantially a double walled hollow structure.

9. A blower as in claim 7 further comprising straps for removably mounting said blower unit and said frame to an operator.

10. A blower as in claim 7 further comprising means for mounting padding on said second portion first side.

11. A blower as in claim 7 wherein said first portion comprises holes therethrough for passage of air.

12. A back pack for use in carrying a blower, the back pack having an L-shaped frame and straps for removably supporting the back pack and a blower on an operator, said frame comprising:

means for mounting a blower to said frame; and means for substantially preventing intrusion of foreign objects into a blower air inlet and for reducing noise emanating from a blower air inlet including an inlet restrictor ring extending from a wall of said L-shaped frame intended to have the blower air inlet located in close proximity thereto, said ring being adapted to substantially surround an air inlet of a blower mounted to the back pack and form a restrictive space between said wall and an air inlet for operably cooperating with an air inlet of a blower to allow air to flow through the space, but to prevent intrusion of foreign objects and reduce noise without substantially restricting flow of air through said space.

* * * * *